US011781275B2

(12) United States Patent
Neusch

(10) Patent No.: US 11,781,275 B2
(45) Date of Patent: Oct. 10, 2023

(54) POST AND BEAM VEHICLE BARRIER

(71) Applicant: Neusch Innovations, LP, Burnet, TX (US)

(72) Inventor: William H. Neusch, Marble Falls, TX (US)

( * ) Notice: Subject to any disclaimer, the term of this patent is extended or adjusted under 35 U.S.C. 154(b) by 0 days.

(21) Appl. No.: 17/549,687

(22) Filed: Dec. 13, 2021

(65) Prior Publication Data

US 2022/0162818 A1 May 26, 2022

Related U.S. Application Data

(63) Continuation of application No. 16/224,544, filed on Dec. 18, 2018, now Pat. No. 11,198,980.

(60) Provisional application No. 62/607,245, filed on Dec. 18, 2017.

(51) Int. Cl.
*E01F 13/12* (2006.01)

(52) U.S. Cl.
CPC ..... *E01F 13/12* (2013.01)

(58) Field of Classification Search
None
See application file for complete search history.

(56) References Cited

U.S. PATENT DOCUMENTS 2,123,167 A * 7/1938 Cain ..... E01F 15/0461 256/13.1
9,644,393 B2 * 5/2017 McCue ..... E04H 17/18

FOREIGN PATENT DOCUMENTS

GB 2588223 A * 4/2021 ..... E01F 13/12

* cited by examiner

*Primary Examiner* — Thomas B Will
*Assistant Examiner* — Katherine J Chu
(74) *Attorney, Agent, or Firm* — BRADLEY ARANT BOULT CUMMINGS LLP; Henry L. Ehrlich

(57) ABSTRACT

A vehicle barrier includes a beam extending longitudinally between opposing end posts, the beam positioned vertically above a ground level and separating an asset side from an attack side, the beam comprising beam sections and a crash post positioned in a same vertical plane as the beam, wherein beam sections are pivotally connected to the crash post.

20 Claims, 16 Drawing Sheets

POST AND BEAM VEHICLE BARRIER

BACKGROUND

This section provides background information to facilitate a better understanding of the various aspects of the disclosure. It should be understood that the statements in this section of this document are to be read in this light, and not as admissions of prior art.

Vehicle barrier systems are used to prevent vehicles from entering a predetermined location. Anti-ram vehicle barriers (AVB) systems or vehicle security barriers (VSB) are configured to stop motor vehicles, such as trucks, that are intentionally crashed into the barrier in an attempt to breach the barrier and enter the protected area for nefarious purposes. Passive barriers are static after installation and deployment, in other words, passive AVBs "never" allow vehicular access to certain areas, while active AVBs (e.g., gates, drop arms, active wedges) control or limit vehicular access to a particular area.

Some anti-ram vehicle barriers are crash tested to ensure compliance with and obtain certification from a recognized standard. For example, the American Standard Test Method (ASTM F2656 Standard Test Method for Vehicle Crash Testing of Perimeter Barriers), British Standard Institute (PAS 68) and the International Organization for Standardization (ISO) and International Works Agreement (IWA 14-1).

The U.S. State Department (DOS) published the certification standard SD-STD-02.01 (Test Method for Vehicle Crash Testing of Perimeter Barriers and Gates) in 1985. The test vehicle was specified as a medium-duty truck weighing 15,000 lb. (6800 kg) and the nominal velocities were 30 mph (50 km/hr.), 40 mph (65 km/hr.) and 50 mph (80 km/hr.). Penetration was measured from the pre-impact attack (front) side of the vehicle security barrier (VSB) and classified into three categories of penetration rating. In 2003, the standard was revised with measuring the penetration from the asset or protected (rear) side of the barrier and the limitation of permissible vehicle penetration to one meter (the highest level of penetration rating).

In 2007, the SD-STD-02.01 was replaced with ASTM F2656-07. This new standard included the medium-duty truck and added three new test vehicle types, a small passenger car, pickup truck, and a heavy goods truck. ASTM F2656-07 maintained three predetermined impact velocities for each vehicle category and penetration is measured from the rear face of the barrier and classified into four categories of penetration rating. The penetration ratings include P1 for less than or equal to 1 meter (3.3 ft.); P2 for 1.10 to 7 m (3.31 to 23.0 ft.); P3 for 7.01 to 30 m (23.1 to 98.4 ft.); and P4 for 30 m (98 ft.) or greater. ASTM F2656 was revised in 2015 (ASTM F2656-15) to include two additional vehicle types, a full-sized sedan and a cab over/cab forward class 7 truck and it excluded the lowest penetration rating (P4).

In 2005, the British Standard Institute (BSI) published PAS 68:2005 Specification for Vehicle Barriers: Fixed Bollards. The standard was expanded within two years to include other types of barriers, such as gates and road blockers. The 2013 version, "Impact Test Specifications for Vehicle Security Barrier Systems," rates vehicle barrier systems based on six types of test vehicles, including seven test speeds, and penetration is measured from the rear (protected side) face of the barrier. PAS 68 defines the vehicle type, penetration, dispersion of debris and records the angle of the vehicle's approach. The PAS 68 rating includes a 5-to-7-part classification code, the includes: Classification of Test/Gross Weight of Vehicle (kgs) (Vehicle Class)/Impact Speed/Angle of Impact: Distance Leading Edge of Load Bay travels beyond the Original Position of Rear Face/Dispersion Distance of major debris weighing 25 kg or more from the barrier to establish stand-off distance. For example, a barrier (bollard) tested by impact by a 7500 kg day cab ("V") at a ninety-degree angle traveling 80 km/hr. and resulting in penetration of 7.5 m with significant debris scattered up to 20.0 m away would be designated as V/7500(N3)/80/90:7.5/20.0. The dispersion distance can be used to determine a stand-off distance for example to mitigate damage from a vehicle born improvised explosive device (VBIED).

The European Committee for Standardization (CEN), recognized across 34 European countries, has produced a standard CWA 16221 that combines details of BS PAS 68 and PAS 69. PAS 69 provides guidance on the barrier's use and installation.

The 2013 International Works Agreement (IWA) 14-1: 2013 provides an international specification for crash-testing. The system was developed by government agencies, military bodies and providing companies from the USA, UK, Germany, Norway, Oman, Singapore and Syria. This standard includes a merging of vehicle impact test specifications of the British PAS 68 and the American ASTM F2656. This international standard assesses vehicle barrier performance based on nine types of test vehicles with up to seven test speeds. Penetration is measured from the front (attack side) face of the VSB. The IWA 14 classification code represents Vehicle Impact Test/Gross Weight of Vehicle (Vehicle Class)/Impact Speed/Angle of Impact/Penetration beyond the original position of the Front/Impact face.

SUMMARY

An exemplary vehicle barrier includes a beam extending longitudinally between opposing end posts, the longitudinally extending beam positioned vertically above a ground level and separating an asset side from an attack side, the beam comprising beam sections and a crash post positioned in a same vertical plane as the beam, wherein adjacent beam sections are pivotally connected to the crash post.

An exemplary anti-ram vehicle barrier includes a beam extending longitudinally between opposing end posts, the longitudinally extending beam positioned vertically above a ground level and separating an asset side from an attack side, the beam comprising beam sections; a plurality of crash posts positioned in a same vertical plane as the beam, the adjacent beam sections pivotally connected to the crash posts, wherein the crash posts include a beam having a web separating an attack side flange facing the attack side from an asset side flange facing the asset side, the web extending perpendicular to the longitudinally extending beam and a beam connector plate having a first vertical hole and a second vertical hole, the beam connector plate disposed through the web position the first and the second vertical holes on opposite sides of the web. The adjacent beam sections pivotally connected to the beam connector plate on opposite sides of the web.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
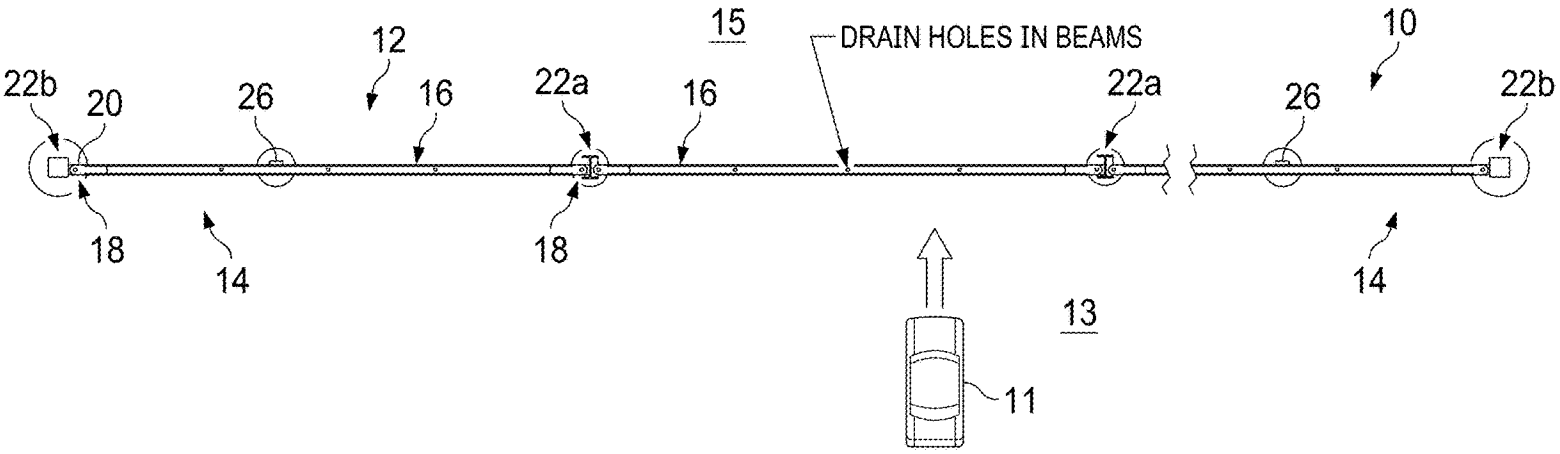
FIG. 1 is a plan view of a longitudinally extending section of an exemplary anti-ram vehicle barrier according to aspects of the disclosure.

It is to be understood that the following disclosure provides many different embodiments, or examples, for implementing different features of various illustrative embodiments. Specific examples of components and arrangements are described below to simplify the disclosure. These are, of course, merely examples and are not intended to be limiting. For example, a figure may illustrate an exemplary embodiment with multiple features or combinations of features that are not required in one or more other embodiments and thus a figure may disclose one or more embodiments that have fewer features or a different combination of features than the illustrated embodiment. Embodiments may include some but not all the features illustrated in a figure and some embodiments may combine features illustrated in one figure with features illustrated in another figure. Therefore, combinations of features disclosed in the following detailed description may not be necessary to practice the teachings in the broadest sense and are instead merely to describe particularly representative examples. In addition, the disclosure may repeat reference numerals and/or letters in the various examples. This repetition is for the purpose of simplicity and clarity and does not itself dictate a relationship between the various embodiments and/or configurations discussed.

Embodiments of the disclosed anti-ram vehicle barrier 10 are configured to be crash-rated by certifying agencies such as DOD, DOS, American Standard Test Method (ASTM), British Standards Institution (BSI) and International Standardization Institution (ISO). Vehicle barriers are tested by crashing a motor vehicle from an attack side in a perpendicular direction into the barrier. The vehicle barrier is rated based on the test vehicles weight, the speed of impact, and the penetration of the vehicle (e.g., the cargo bed) beyond the pre-impact inside edge of the barrier. For example, a "K" (SD-STD-02.01) or "M" (ASTM F2656) designates a medium duty vehicle with a gross weight of 15,000 pounds (6810 kg). The speed ratings include K4/M30 for traveling at 28.0 to 37.9 miles per hour (mph); K8/M40 traveling at 38.0 to 46.9 mph, and K12/M50 traveling at 47.0 mph and above. The penetration ratings include P1 for less than or equal to 1 meter (3.3 ft.); P2 for 1.10 to 7 m (3.31 to 23.0 ft.); and P3 for 7.01 to 30 m (23.1 to 98.4 ft.). For example, an M50-P1 crash barrier is designed to stop a medium duty truck traveling 50 mph with a penetration distance of 3.3 feet or less. Some embodiments of the disclosed anti-ram vehicle barrier 10 may be engineered crash-rated but not crash tested. Some embodiments of the disclosed anti-ram vehicle barrier 10 may not be engineered crash-rated or crash tested.

Figure 2:
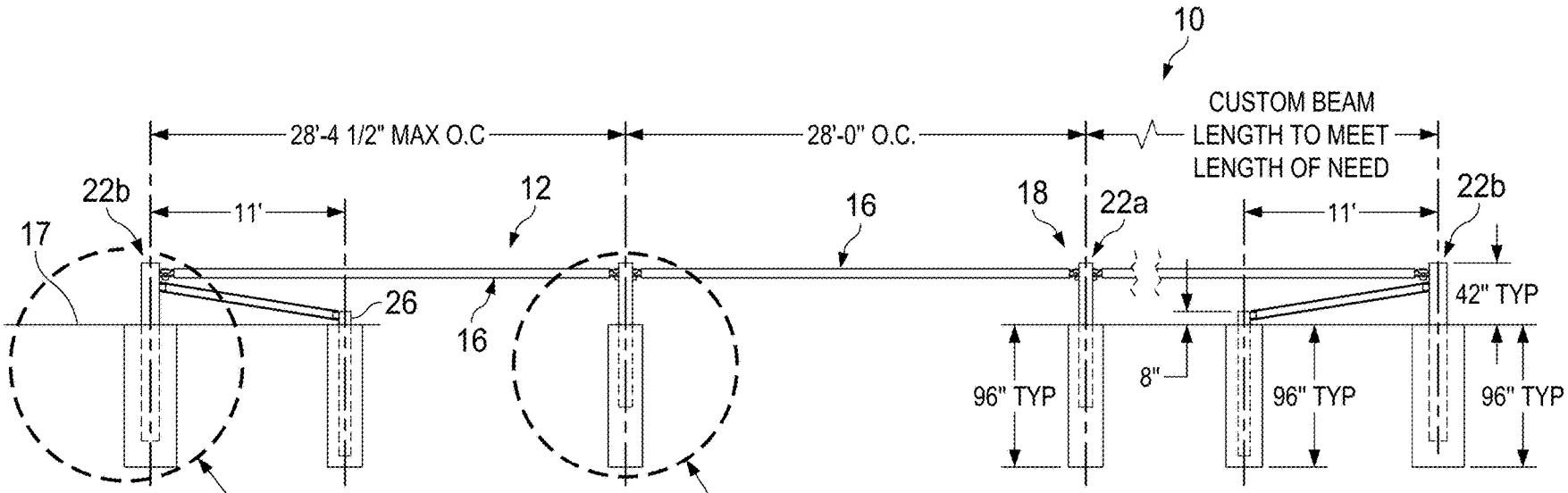
FIG. 2 is an elevation view of a portion of the exemplary anti-ram vehicle barrier of FIG. 1.
Figure 3:
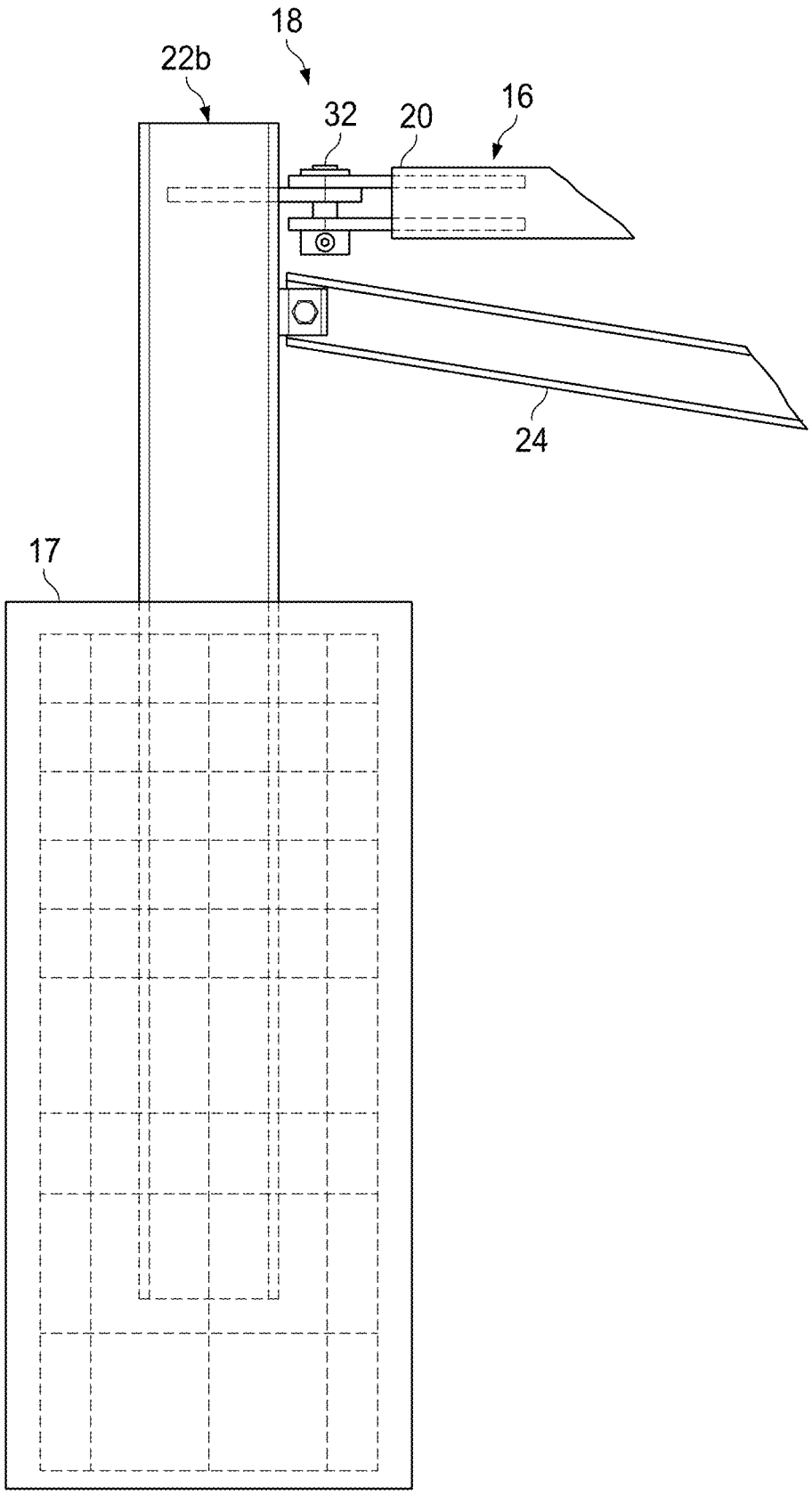
FIG. 3 illustrates an exemplary end post to beam connection according to aspects of the disclosure.

FIG. 1 is a plan view of an exemplary passive anti-ram vehicle barrier (AVB), generally denoted by the numeral 10, arranged in a post and beam arrangement according to aspects of the disclosure. FIG. 2 is an elevation view of passive anti-ram vehicle barrier 10 illustrated in FIG. 1. AVB 10 is configured to stop a motor vehicle 11 traveling from an attack side 13 that crashes into AVB 10 from penetrating beyond a selected distance from AVB 10 into the protected or asset side 15. In a post and beam arrangement, braces are not used to achieve an anti-ram vehicle barrier rating. FIGS. 1 and 2 illustrate an embodiment configured to meet the crash criteria to achieve an M50-P1 rating under ASTM F2656 or a similar rating.

In FIG. 1, AVB 10 is positioned between a protected or asset side 15 and a motor vehicle 11 approaching AVB 10 from an attack side 13. AVB 10 includes a continuous beam 12 positioned above ground level 17. AVB 10 may include one or more truss sections 14. In the illustrated examples, truss sections 14 are illustrated at the terminal ends of a longitudinal length of continuous beam 12. It will be recognized by those skilled in the art with the benefit of this disclosure, that two or more longitudinal lengths of continuous beam 12 may be arranged together to form an extended length of need. Beam 12 is formed of interconnected beam sections 16. Adjacent beams sections 16 are connected at joints 18. Joints 18 are pivoting connections that permit a degree of pivoting movement between adjacent beam sections 16 or a beam section and a post when beam 12 is impacted by a motor vehicle.

Posts, generally denoted by the numeral 22, are connected to beam 12, for example, to support beam 12 above ground level and to provide tension to mitigate lift of beam 12 in response to the impact of the motor vehicle. Posts 22 are metal members and may take various forms including I-beams, round or rectangular (e.g., square) members. Posts 22 may be arranged in a line or crash post configuration, identified specifically with reference number 22*a*, connected to beam 12 at a joint 18 and between adjacent beam sections. In a post and beam arrangement, braces do not extend from a crash post to the ground in the direction toward asset side 15. Posts 22 may be arranged in an end or corner post configuration, identified specifically with the reference number 22*b*, connected to continuous beam 12 at a joint 18. Posts 22 may be arranged in an intermediate configuration, identified specifically with reference number 22*c* (see, e.g., FIGS. 14-15), connected directly to beam 12 at an intermediate position between joints 18. Some or all of posts 22 may be used to support an ornamental fence structure, e.g., a chain link section.

Crash posts 22*a* and end posts 22*b* provide the structural strength in a post and beam arrangement to resist vehicle penetration to meet standardized test criteria. In some embodiments, crash posts 22*a* and end posts 22*b* are located in the same vertical plane as beam 12. Intermediate posts 22*c* are located within the beam span between joints 18 that connect adjacent beam sections 16 or beams sections 16 to crash posts 22*a* or end posts 22*b*. Intermediate posts 22*c* may be connected to the beam, for example, to provide vertical support to beam 12 between relatively long spans between crash posts and to provide tension to the beam relative to the foundation to prevent lift of the beam when impacted by a vehicle. AVB 10 illustrated in FIGS. 1 and 2 does not have intermediate posts due to the short span between the adjacent crash posts 22*a*.

Figure 4:
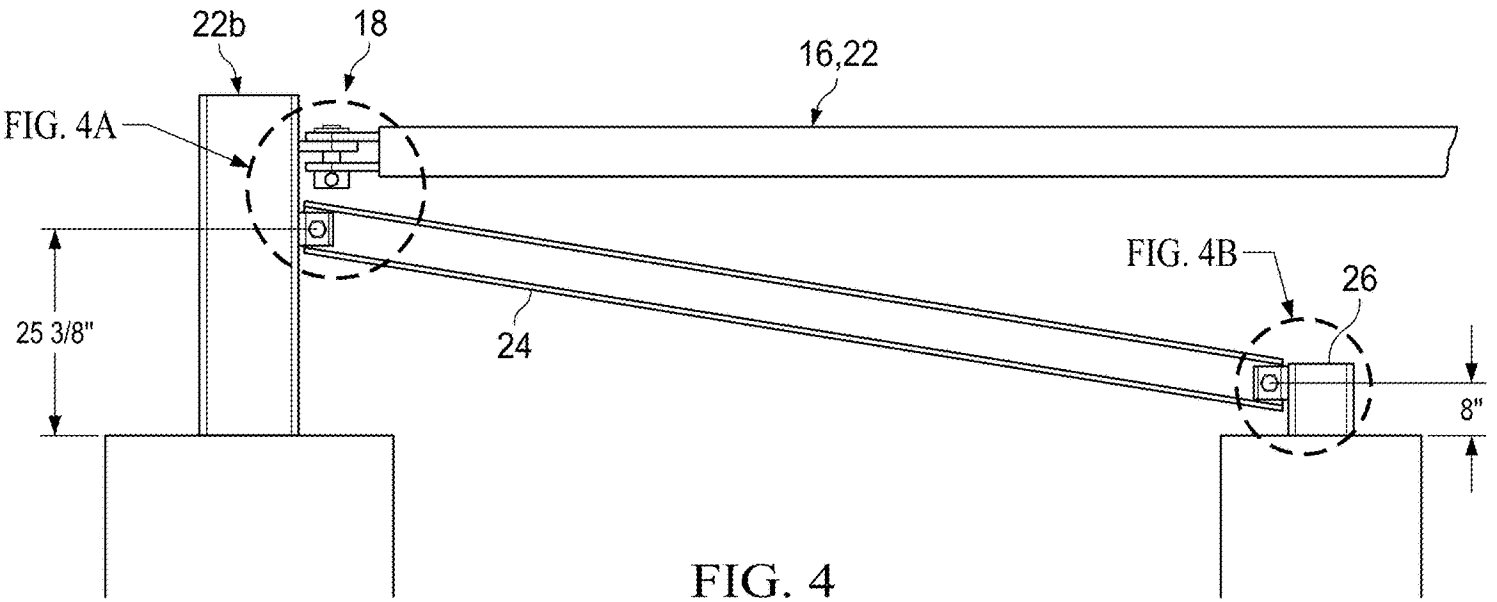
FIG. 4 illustrates an exemplary truss section according to aspects of the disclosure.
Figure 4B:
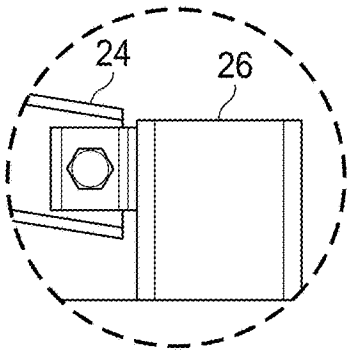
FIG. 4B is an expanded view of a portion of the truss section of FIG. 4.
Figure 5:
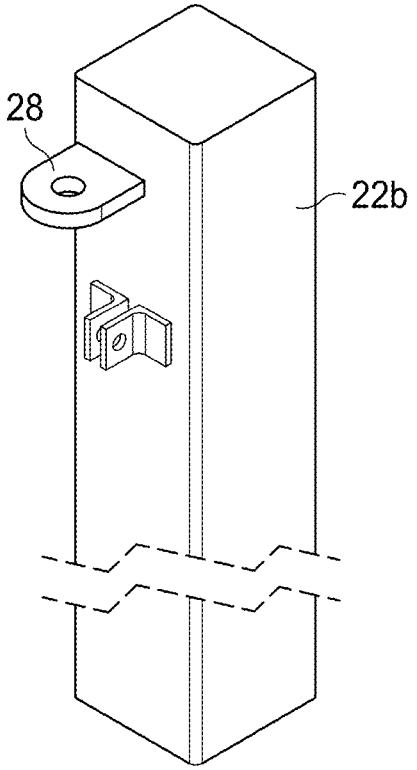
FIG. 5 is a perspective view of an exemplary end post according to aspects of the disclosure.
Figure 6:
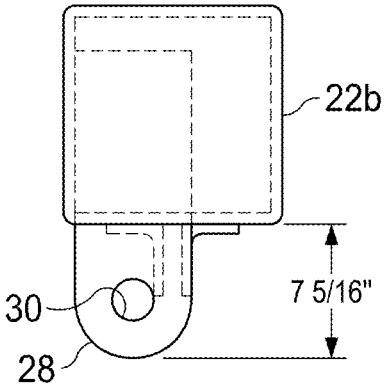
FIG. 6 is a plan view of the end post illustrated in FIG. 5.
Figure 7:
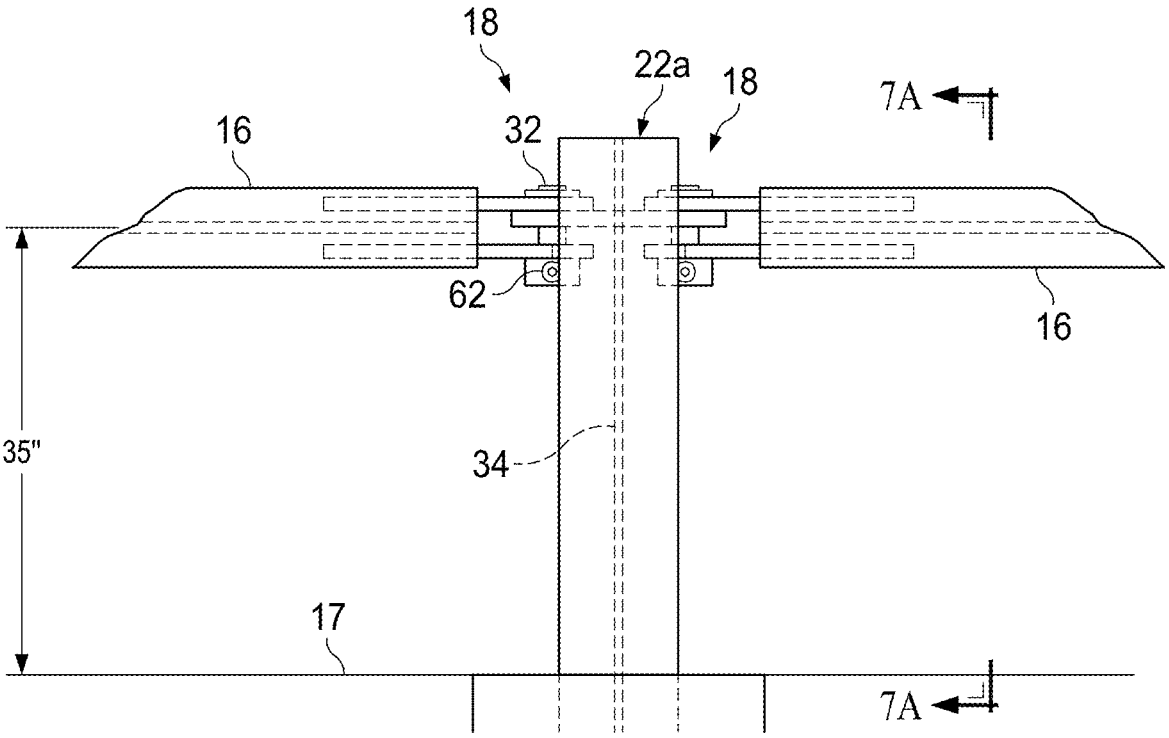
FIG. 7 illustrates an exemplary crash post and beam connection according to aspects of the disclosure.
Figure 7A:
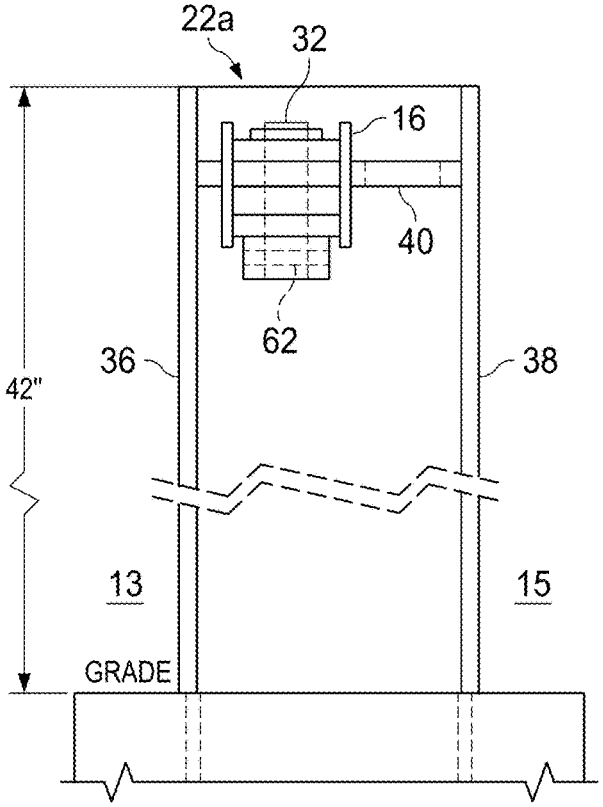
FIG. 7A illustrates a view along the line 7A-7A in FIG. 7.
Figure 7B:
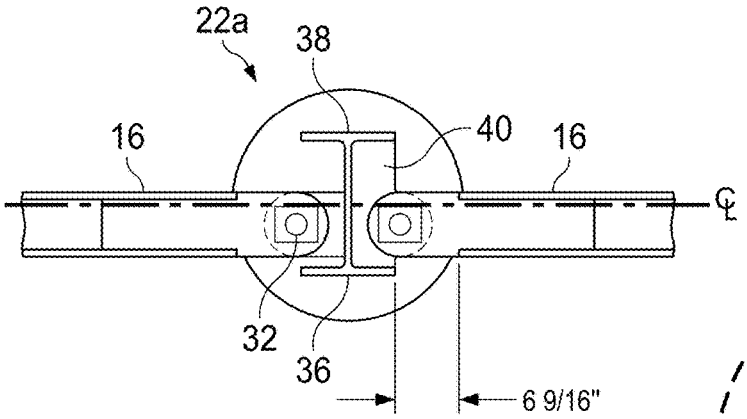
FIG. 7B is a plan view of the exemplary crash post and beam connection of FIG. 7.
Figure 7C:
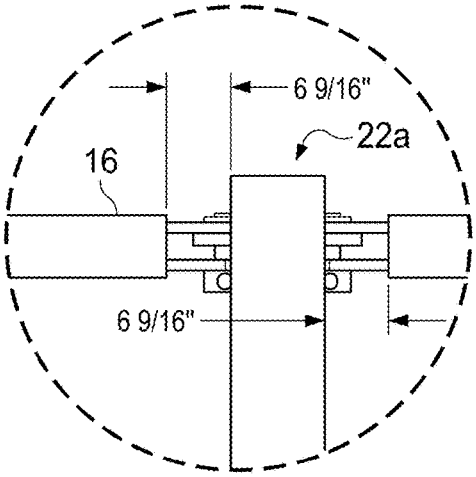
FIG. 7C is an expanded view of the exemplary crash post and beam connection of FIG. 7.

FIGS. 1 and 2 illustrate a linear section of AVB 10 extending between opposing end posts 22*b* that meets the M50-P1 crash testing criteria under ASTM F2656. The terminal ends 20 of a linear section of beam 12 are connected to the respective end posts 22*b*. An example end post 22*b* is illustrated in FIGS. 4-6. A corner end post, although not shown, may be similarly configured for beam sections to extend in two different directions. As will be understood by those skilled in the art with the benefit of this disclosure, connection joints 18 (e.g., beam to crash or end post, or beam to beam) may allow vertical movement of the interconnected elements relative to one another to accommodate grade changes along the length of the barrier. In the illustrated example, the height from grade to beam center is 35 inches+/−3 inches for grade change between crash posts 22*a*. In some embodiments, beam 12 can accommodate a grade change of about 11 degrees at connection joints 18 providing a maximum grade change of 22 degrees at each crash post 22*a*. The concrete foundation is a minimum 3500 psi, and in an example, reinforced with No. 3 and No. 5 rebar. In the illustrated example of an M50-P1 barrier, the spacing between adjacent crash posts 22*a* is approximately 28 feet and the beams sections 16 are interconnected at crash posts 22*a*. For reference, a single connector plate is referred to as a male connector, or male end, and a double connector plate arrangement is referred to as a female connector or a female end. In an exemplary AVB 10, beam sections 16 may be constructed for example of W6×25 or W6×20 beams, end posts 22*b* of HSS (hollow square sections) of 12"×12"×0.5" ASTM A36 steel tube, crash posts 22*a* of W14×61 beams, and the various connector plates 28, 40, 54 by 1-to-1.5-inch ASTM A572 Gr. 50 steel plate.

In the embodiment of FIGS. 1 and 2, AVB 10 includes trusses 14 and end posts 22*b*. With additional reference to FIGS. 3, 4, 4A, and 4B, trusses 14 include a kicker brace 24 that extends from end post 22*b* substantially in-line with beam 12, and below beam 12, to a foundation post 26. In an exemplary embodiment, kicker brace 24 may be constructed of W6×25 or W6×20 beam and foundation brace post 26 of 8"×8"×0.375" tubular steel. As illustrated for example in FIGS. 1 and 2, truss kicker brace 24 and foundation post 26 are located substantially vertically below beam 12 as opposed to extending laterally away from the longitudinal axis of beam 12. In some embodiments, AVB 10 may not include a kicker brace (e.g., truss) at end post 22*b*. For example, a post and beam AVB 10 constructed in according to aspects of FIGS. 1 and 2, with the exception of an end section kicker brace, or truss, may achieve a rating below M50-P1 rating, such as a M50-P2, M50-P3, M40-P1, M40-P2, M40-P3, M30-P1, M30-P2, or M30-P3 rating.

Figure 4A:
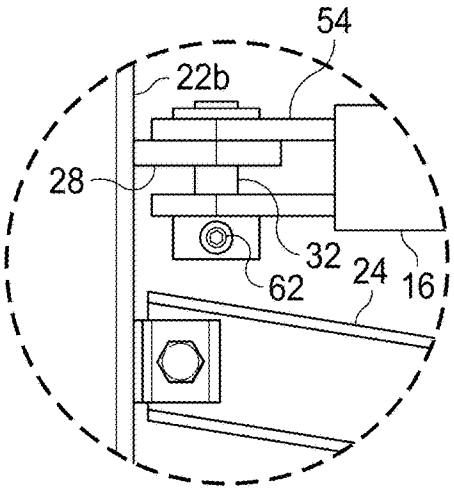
FIG. 4A is an expanded view of a portion of the truss section of FIG. 4.

FIGS. 5 and 6 illustrate an exemplary embodiment of an end post 22*b*. End post 22*b* is constructed, for example, of 12"×12"×0.5" structural steel. A connector plate 28 is directly attached to end post 22*b*. Connector plate 28 includes a vertical hole 30 for disposing a pivot pin 32 such as illustrated in FIG. 4A. In this example, connector plate 28 is a 1.25-inch-thick steel plate.

FIGS. 7, 7A-C, 8, 8A-B, 9, and 9A-B illustrate the connection of adjacent beams sections 16 (e.g., FIGS. 10-13) at a crash post 22*a* This connection of beam sections 16 at pivotal joints 18 to crash post 22*a* are configured in particular to meet the M50-P1 crash test rating. The illustrated crash posts 22*a* provide beam connection joints 18 on opposite sides of crash post 22*a* (e.g., opposite sides of beam web 34). Crash post 22*a* is secured in the ground and oriented such that beam web 34 extends perpendicular to the longitudinal axis of beam sections 16 with an attack side flange 36 located on attack side 13 of AVB 10 and asset side flange 38 positioned on asset side 15 of AVB 10. Adjacent beam sections 16 are pivotally connected to crash post 22*a* and to each other through a beam connector plate 40, also referred to as a beam-post connector plate 40. In this example, beam-post connector plate 40 is a steel plate (e.g., 1 to 1.5 inches thick) having spaced apart pivot pin holes 30, illustrated individually as a pivot holes 30*a*, 30*b* in which pivot pins can be disposed to pivotally connect beam sections 16 to the connector plate. Joint 18 can also permit vertical displacement of the connected members relative to one another to account for grade level changes along the length of AVB 10.

Figure 8:
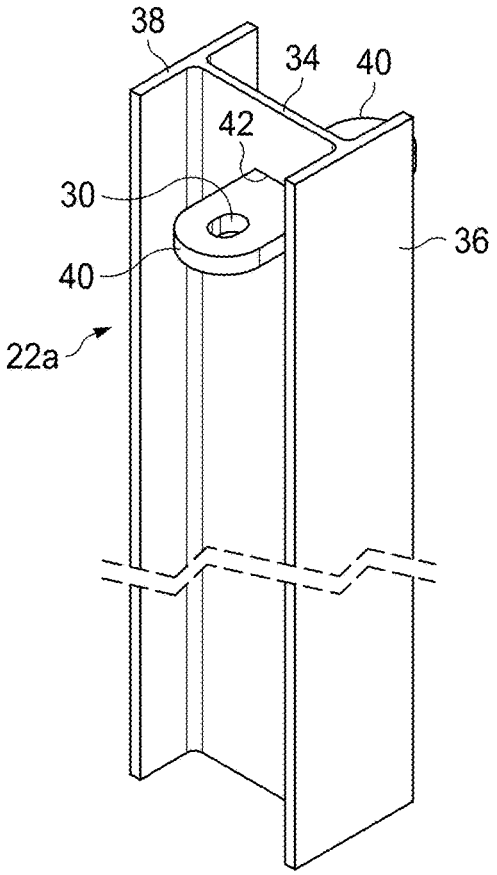
FIG. 8 is a perspective view of an exemplary crash post according to aspects of the disclosure.
Figure 8A:
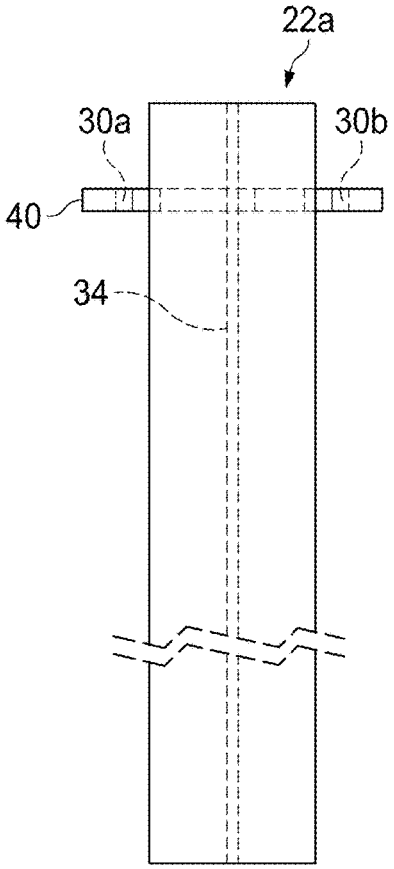
FIG. 8A is a side view of the exemplary crash post of FIG. 8.
Figure 8B:
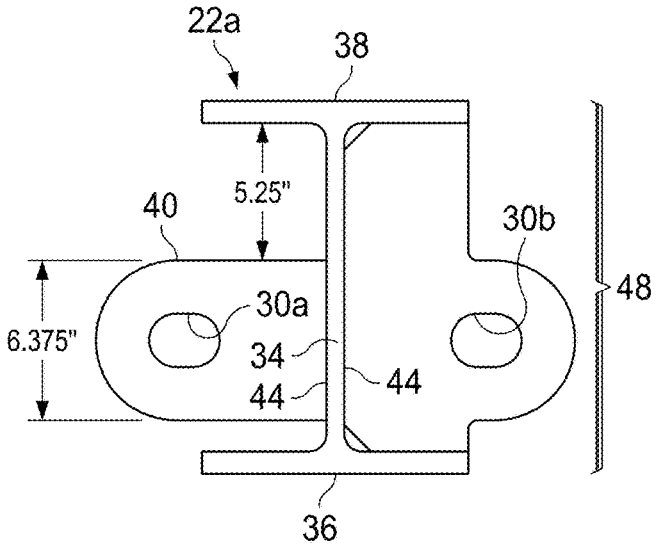
FIG. 8B is a plan view of the exemplary crash post of FIG. 8.
Figure 9:
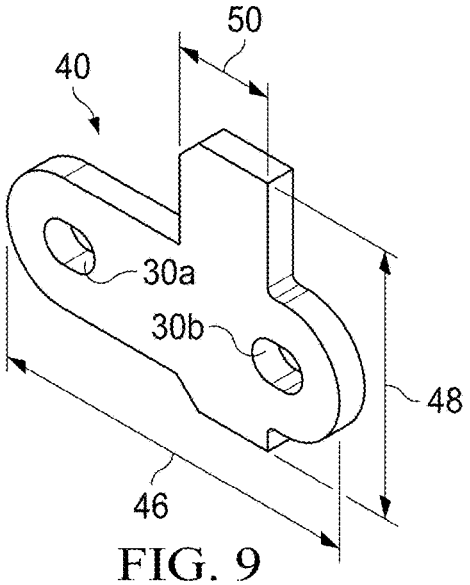
FIG. 9 is a perspective view of an exemplary crash post connector plate according to aspects of the disclosure.
Figure 9A:
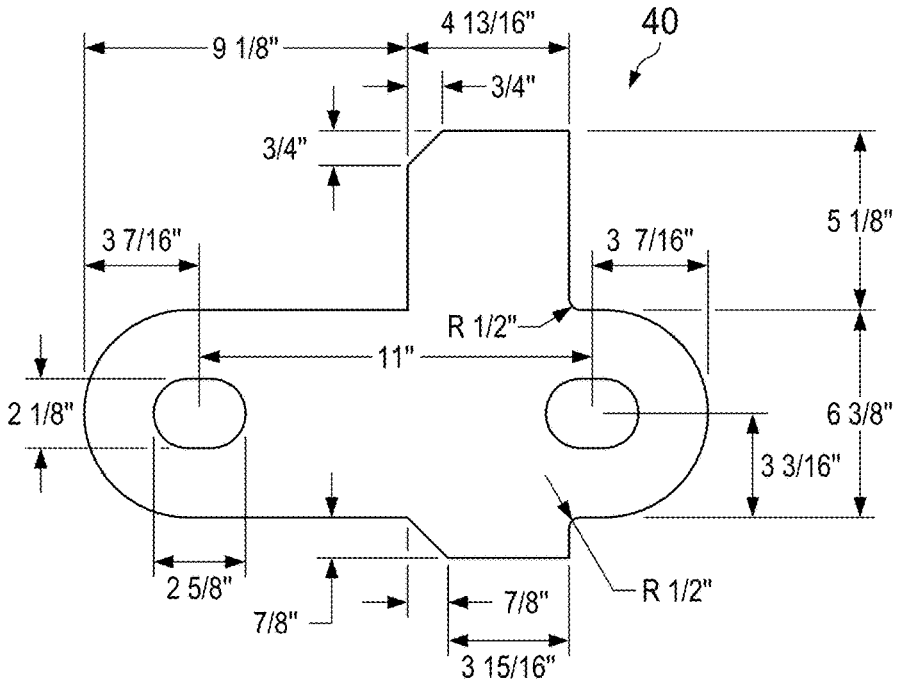
FIGS. 9A and 9B illustrate an exemplary embodiment of the crash post connector plate according to FIG. 9.
Figure 9B:
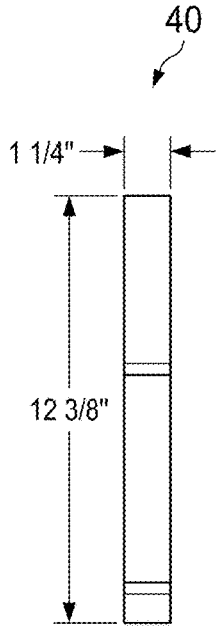
Figure 10:
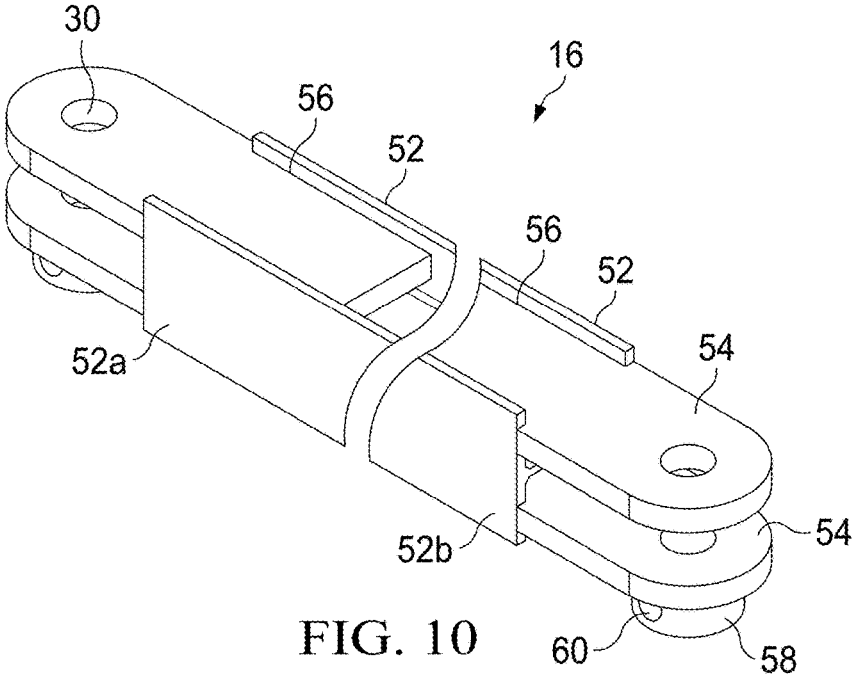
FIG. 10 is a perspective view of an exemplary beam section according to aspects of the disclosure.
Figure 11:
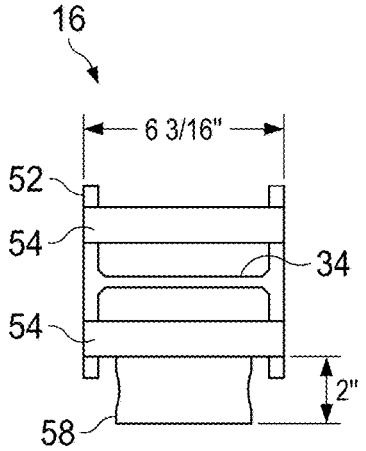
FIG. 11 is an end view of an exemplary beam section according to aspects of the disclosure.
Figure 12:
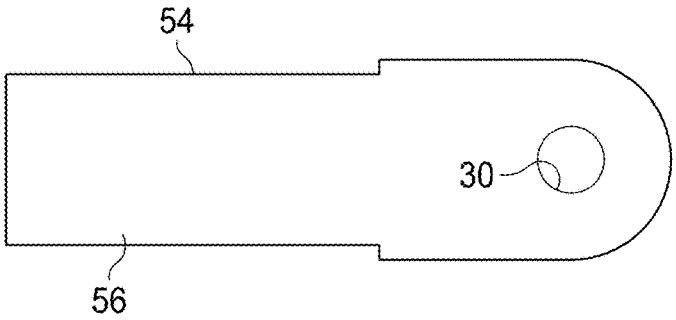
FIG. 12 illustrates an exemplary beam section connector plate according to aspects of the disclosure.
Figure 13:
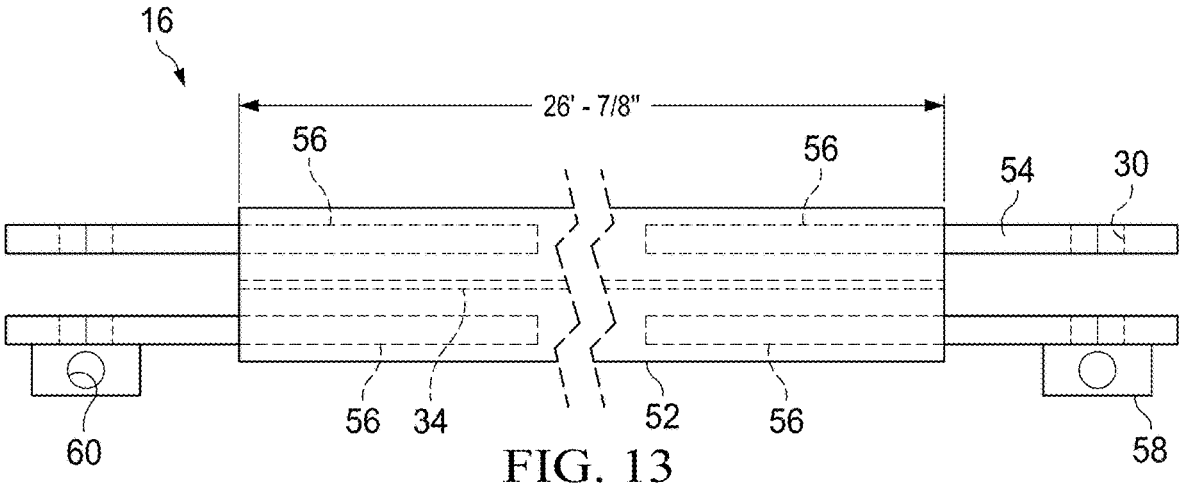
FIG. 13 is a side view of another exemplary beam section according to aspects of the disclosure.
Figure 20:
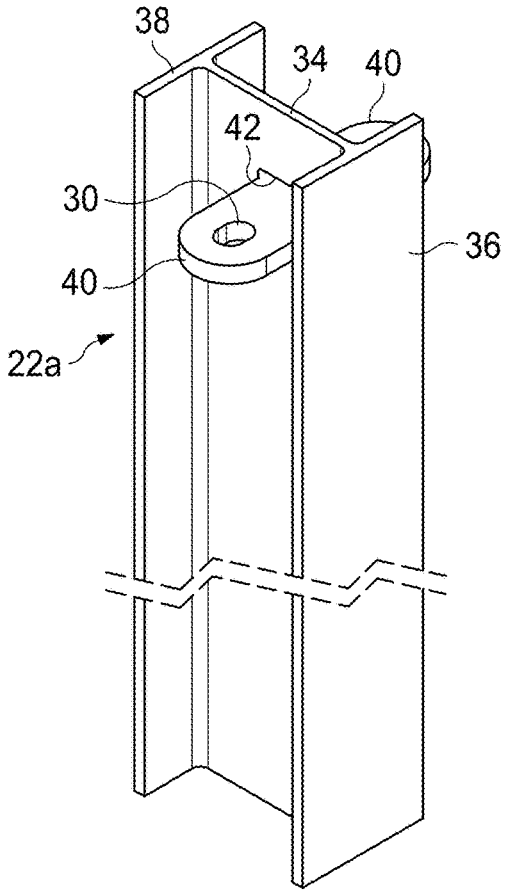
FIG. 20 is a perspective view of another exemplary crash post according to aspects of the disclosure.
Figure 20A:
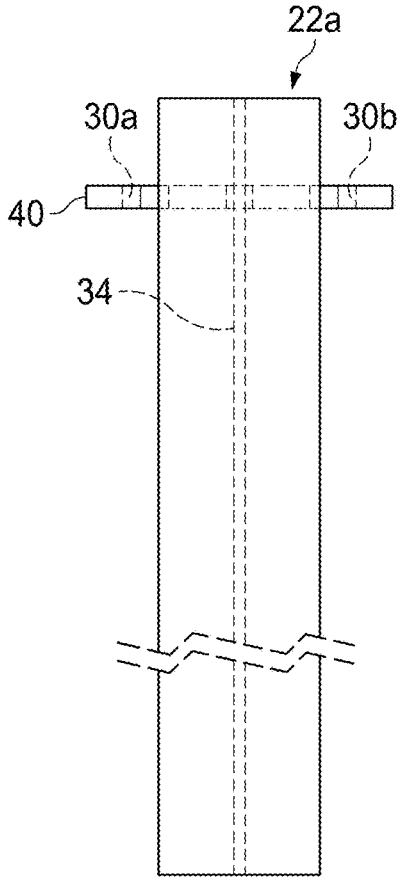
FIG. 20A is a side view of the exemplary crash post of FIG. 20.
Figure 20B:
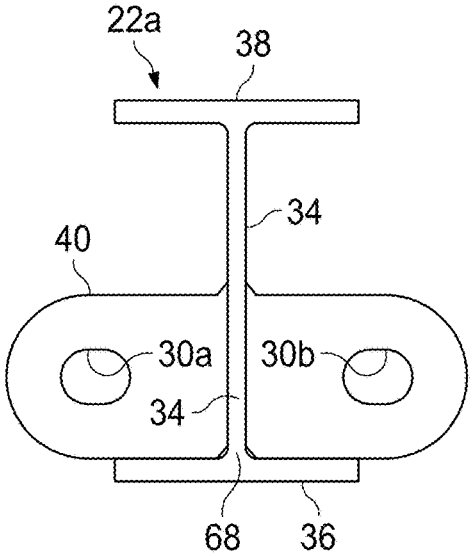
FIG. 20B is a plan view of the exemplary crash post of FIG. 20.
Figure 21:
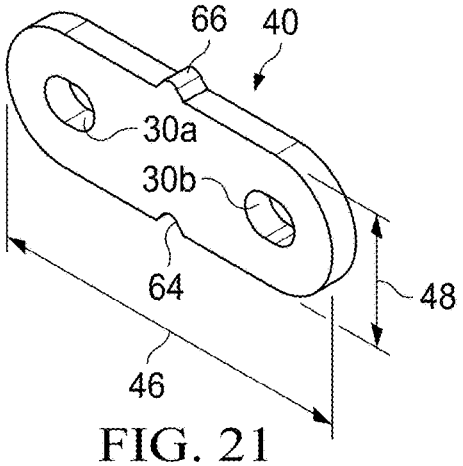
FIG. 21 is a perspective view of another exemplary crash post connector plate according to aspects of the disclosure.
Figure 21A:
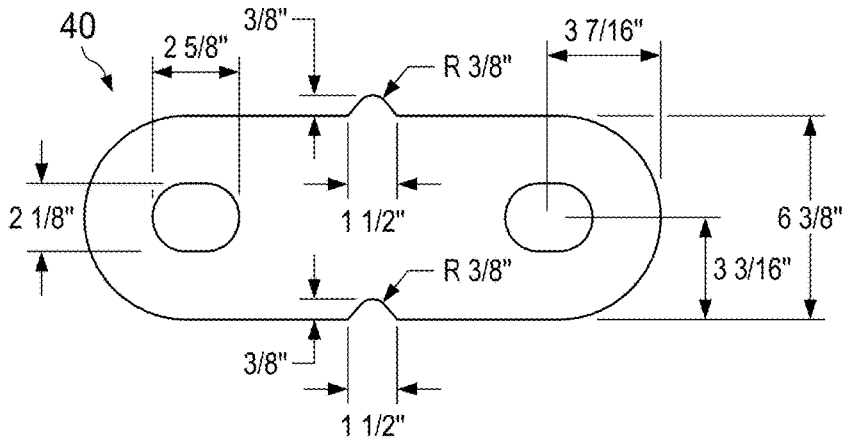
FIGS. 21A and 21B illustrate an exemplary embodiment of the crash post connector plate according to FIG. 21.
Figure 21B:
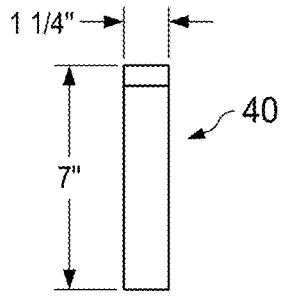

In the illustrated example, beam-post connector plate 40 is a unitary (single structure) that extends through a slot 42 in web 34, and is welded 44 to web 34, positioning pivot pin holes 30*a*, 30*b* that are spaced apart along a longitudinal span 46 on opposite sides of web 34, see, e.g., FIGS. 8A-B, 9. Using two or more connector plates will not depart from the scope of this disclosure. Longitudinal span 46 extends substantially coaxially with the longitudinal axis of the continuous beam. In the illustrated examples, pivot pin holes 30 are located closer to attack side flange 36 than to asset side flange 38 and are located longitudinally outside of the ends of crash post flanges 36, 38. In this embodiment, beam-post connector plate 40 has a lateral span 48 extending perpendicular to longitudinal span 46 and having a length approximately equal to the length of web 34 of crash post 22*a* and lateral span 48 has a width 50 (FIG. 9) proximate to one-half of the flange, i.e., the length of the flange from the web to the outer end of the flange such that lateral span 48 substantially matches and fills the cross-section area defined between the attack flange 36, asset flange 38, and web 34 (FIG. 8B). Thus, beam connector plate 40 fills the cross-sectional area of crash post 22*a* on one side of web 34 and on the opposite side of web 34 beam connector plate 40 does not extend the complete lateral distance between flanges 36, 38. In a less-than M50-P1 crash rating embodiment, see, e.g., FIG. 20B), beam-post connector plate 40 may not have a lateral span 48 that extends the full distance between crash post flanges 36, 38.

In the M50-P1 rated AVB embodiment illustrated in particular in FIGS. 1 and 2, the individual beam sections 16 are connected together at crash posts 22*a* and not interconnected at intermediate positions between crash posts 22*a* as may be performed in some embodiments. For example, AVB 10, illustrated in FIGS. 14 and 15, includes joints 18 that are positioned at intermediate positions in the beam span between crash posts 22*a*, see, e.g., FIG. 19.

FIGS. 10-13 illustrate exemplary beam sections 16. Beam section 16 includes an I-beam 52 having one or more connector plates 54, e.g., warp plates, positioned at opposing ends 52*a*, 52*b*. Each warp plate 54 includes a warp end 56 in direct contact with I-beam 52 and a vertical hole 30 for positioning a pivot pin 32 as shown for example in FIGS. 7 and 7A. Beam section 16 illustrated in FIGS. 10, 11 and 13, includes two vertically separated connector plates 54 at each end 52*a*, 52*b* and may, therefore, be referred to as a female-female beam section. In the illustrated exemplary beam sections 16, a metal housing 58 is attached on the bottom end of the lower connector plate 54 below vertical holes 30. Housing 58 may have lateral opening 60 to align with a cross-hole in the pivot pins to pass a bolt to lock the pivot pin in position. For example, with reference to FIGS. 7 and 7A, a pivot pin 32 is disposed in connector plates 54 and crash post connector plate 40 to form a pivotal joint 18. A cross-pin 62, such as a carriage bolt, is positioned through lateral opening 60 into pivot pin 32 to lock the pivot pin in place and prevent unauthorized removal.

Figure 14:
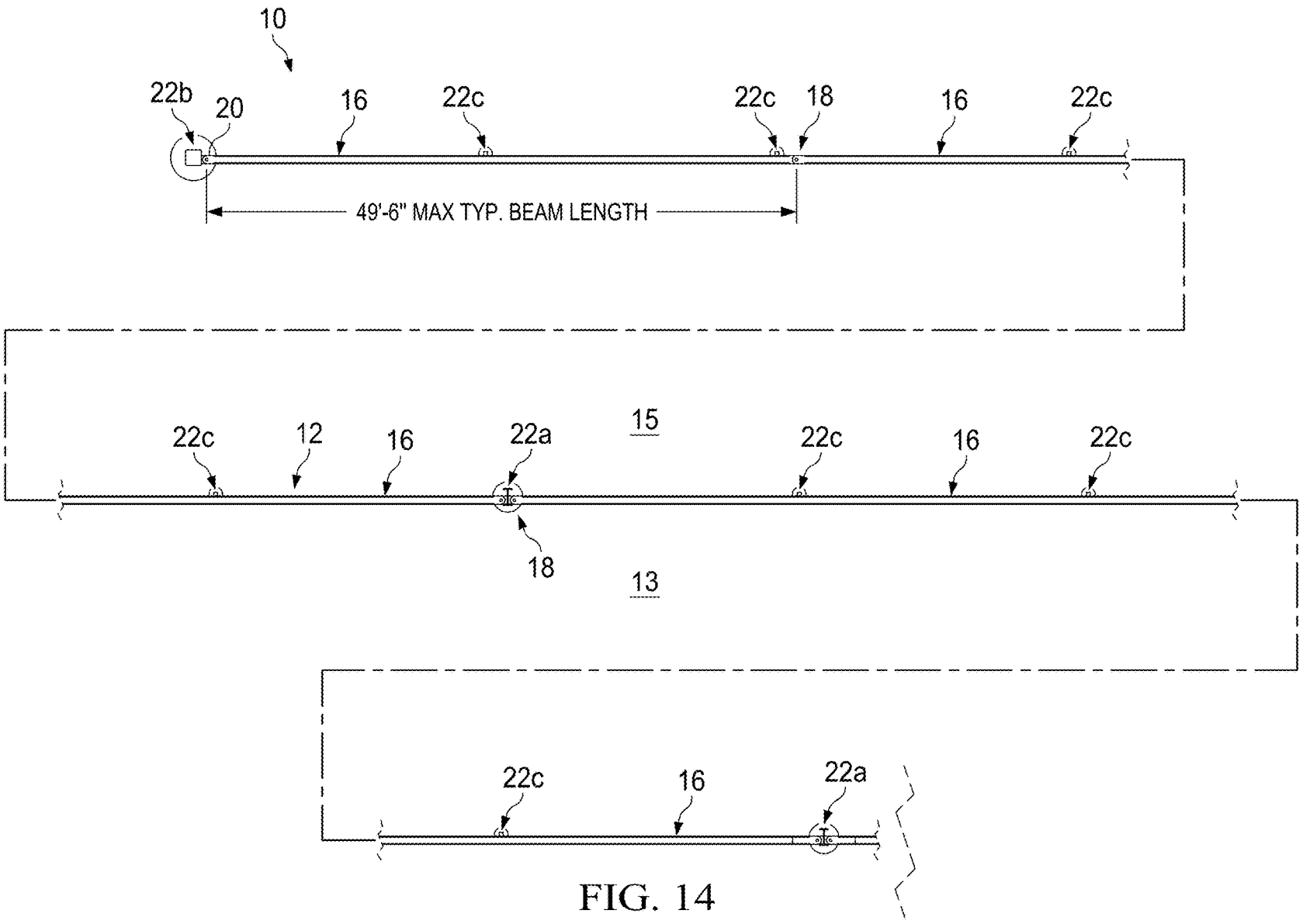
FIG. 14 is a plan view of a section of an exemplary anti-ram vehicle barrier according to aspects of the disclosure.
Figure 15:
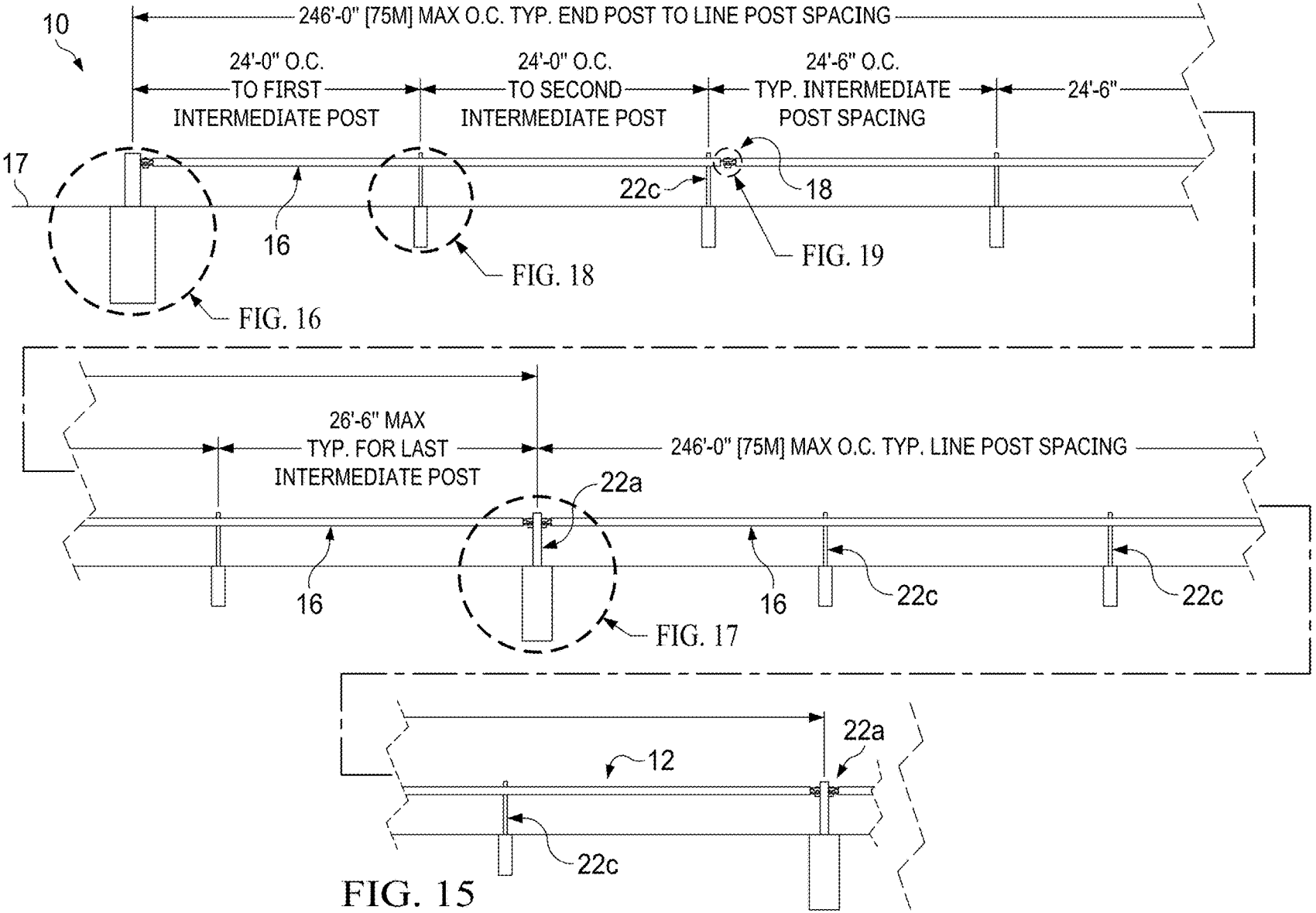
FIG. 15 is an elevation view of a portion of the exemplary anti-ram vehicle barrier of FIG. 14.
Figure 16:
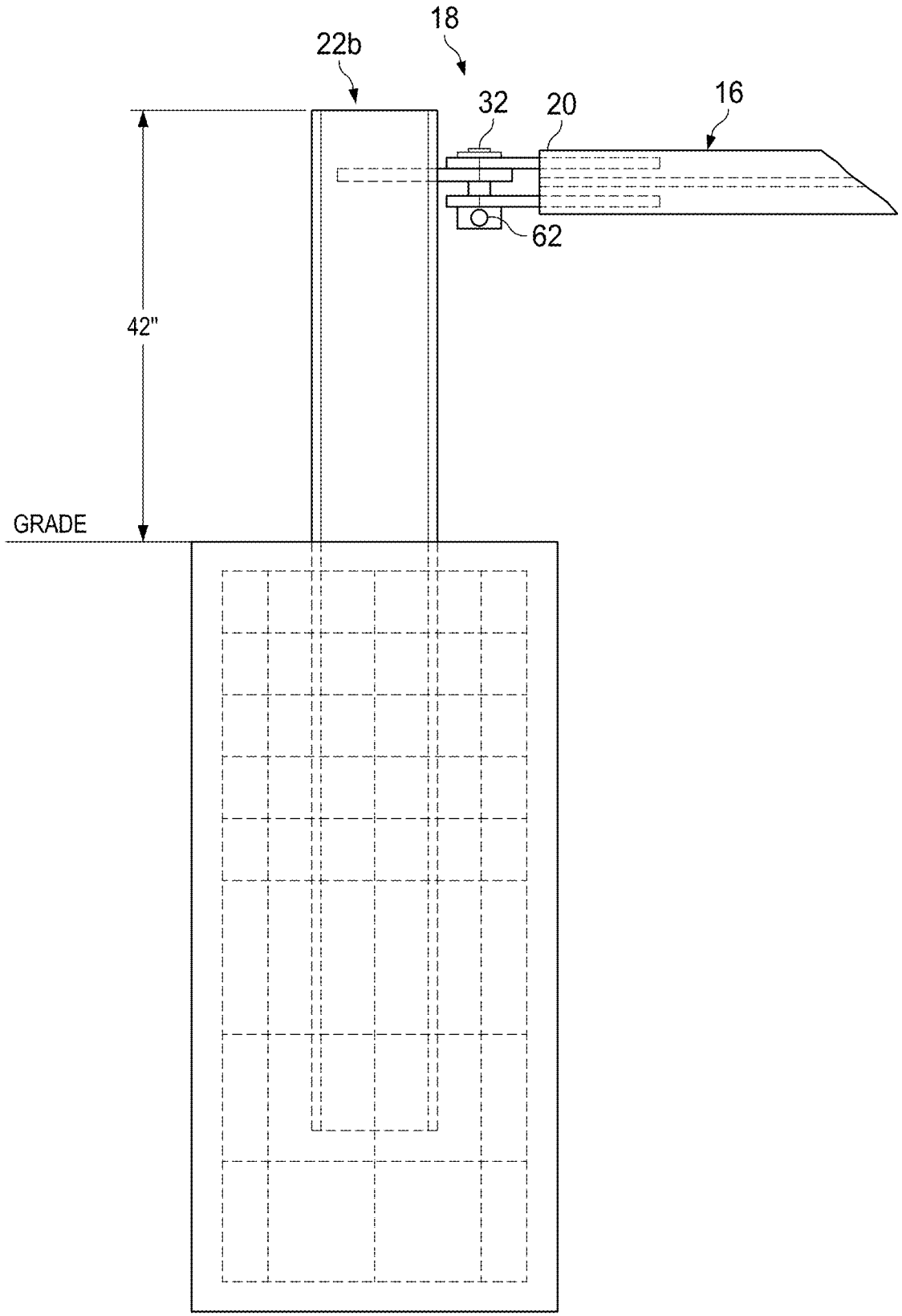
FIG. 16 illustrates another exemplary end post to beam connection according to aspects of the disclosure.
Figure 17:
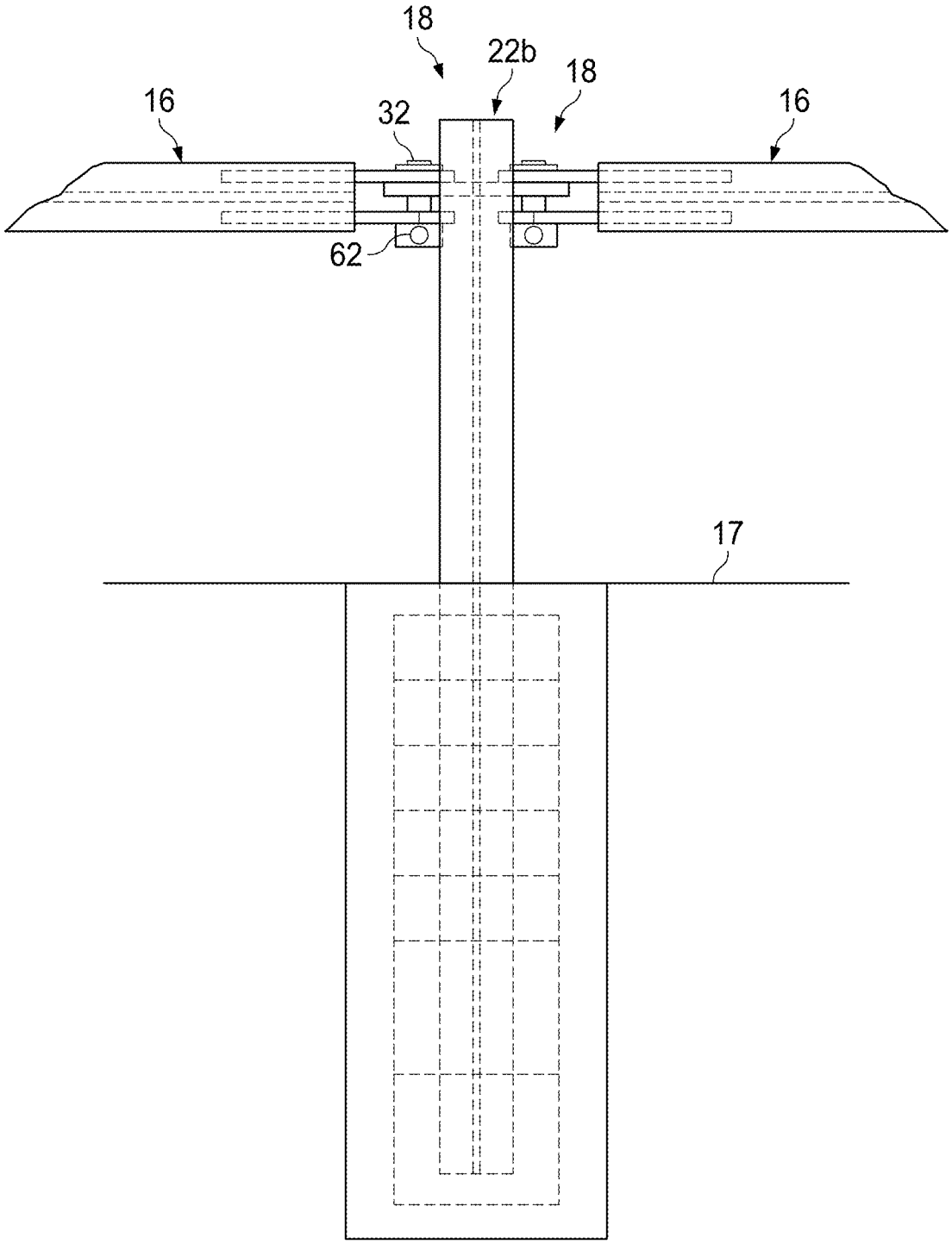
FIG. 17 illustrates an exemplary crash post and beam connection according to aspects of the disclosure.
Figure 18:
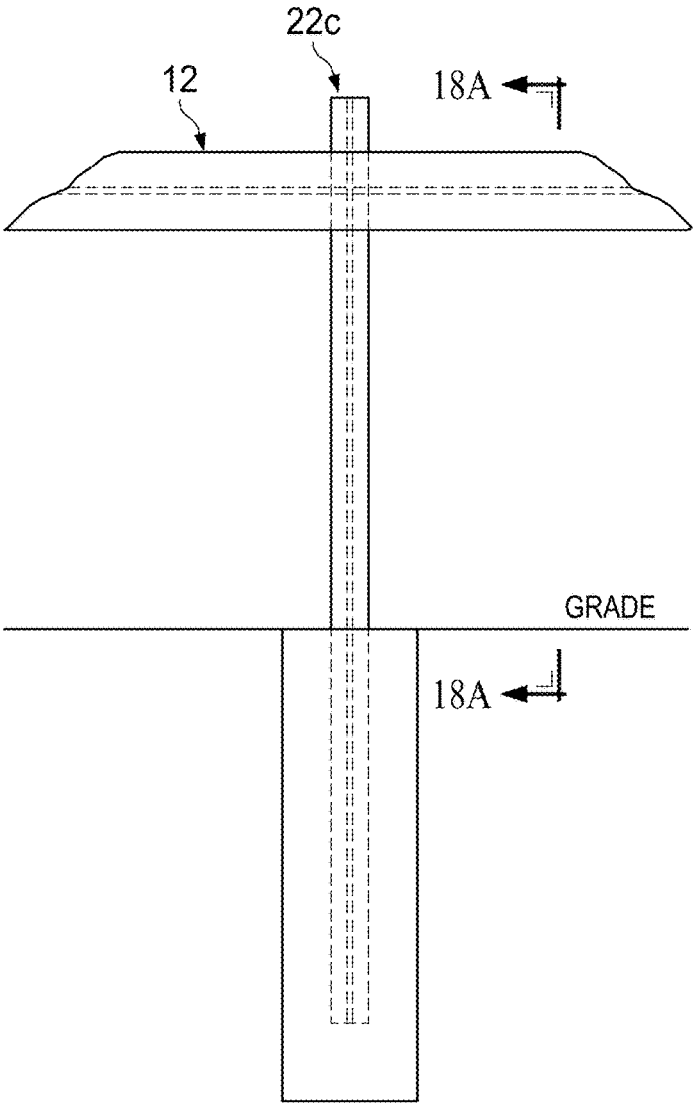
FIG. 18 illustrates an exemplary intermediate post to beam connection according to aspects of the disclosure.
Figure 18A:
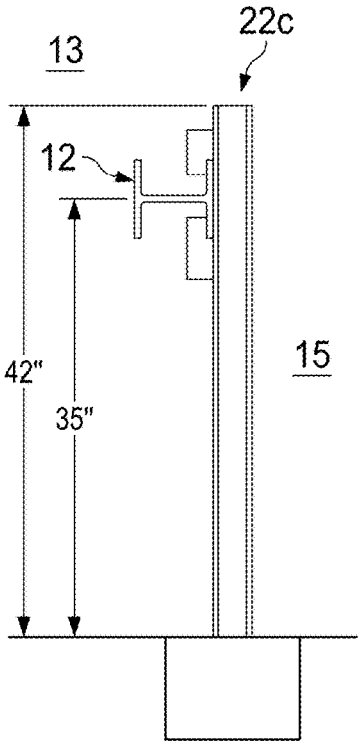
FIG. 18A is a side view of the intermediate post to beam connection illustrated in FIG. 18.
Figure 19:
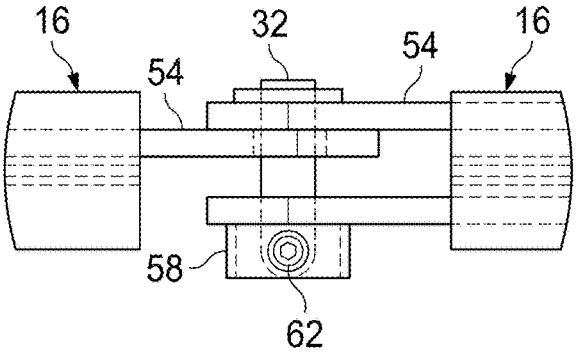
FIG. 19 illustrates an exemplary direct connection of adjacent beam sections according to aspects of the disclosure.

FIGS. 14 and 15 illustrate a linear section of an exemplary post and beam type anti-ram vehicle barrier (AVB) 10. AVB 10 includes a continuous longitudinally extending beam 12 formed by a plurality of interconnected beam sections 16 extending between opposing end posts 22*b*. The terminal ends 20 of a linear section of beam 12 are connected to end posts 22*b* by pivotal connections 18. AVB 10 illustrated in FIGS. 14 and 15 is configured to meet for example the M40-P2 crash testing criteria under ASTM F2656. An example end post 22*b* is illustrated in FIG. 16. A kicker brace is not connected to end post 22*b* as used in the embodiment illustrated in FIGS. 1 and 2. A corner end post, although not shown, may be similarly configured for beam sections to extend in two different directions. As will be understood by those skilled in the art with the benefit of this disclosure, the connection points (joints 18) may allow for vertical movement of the interconnected elements to accommodate grade changes along the length of AVB 10. In the illustrated example, the height from grade to beam center is 35 inches+/−3 inches for grade changes between crash posts. In some embodiments, beam 12 can accommodate a grade change of about 11 degrees at each connection 18 providing a maximum grade change of 22 degrees at crash posts 22*a* (connections 18 on each side of the crash post). The concrete foundation is a minimum 3500 psi, and in an example, reinforced with No. 3 and No. 5 rebar. The spacing between adjacent crash posts 22*a* is approximately 246 feet in the illustrated exemplary M40-P2 rated AVB 10. Beam sections 16 are interconnected by pivotal connections 18 at crash posts 22*a* (FIG. 17), at end post 22*b* (FIG. 16), and at intermediate positions within the beam span between adjacent crash posts 22*a* (FIG. 19). In some embodiments, crash posts 22*a* and end posts 22*b* are located in the same vertical plane as the longitudinally extending beam 12. Intermediate post 22*c* may be located in a different vertical plane, i.e., in front of or behind, then beam 12. For reference, a single connector plate is referred to as a male connector or male end, and a double connector plate arrangement is referred to as a female connector or a female end. Intermediate posts 22*c* may also be connected to beam 12 between adjacent pivotal connections 18 (see, e.g., FIGS. 18, 18A). As shown in FIG. 18A, intermediate post 22*c* is located in a different vertical plane from beam 12. Intermediate post 22*c* is located in a vertical plane on asset side 15 of the vertical plane of beam 12. The individual beam sections 16 (FIG. 23) may have a longer length than the individual beam sections used in other crash test rating or not rated embodiments.

In an exemplary AVB 10, beam sections 16 (FIGS. 23, 24A and 24B) may be constructed of W6×25 or W6×20 beams, crash posts 22*a* constructed of W14×61, W14×30, or W14×38 beams, end posts 22*b* by HSS (hollow square sections) of 12"×12"×0.5" ASTM A36 steel tube, intermediate posts 22*c* of W13×5.7 beams, and various connector plates 28, 40, 54 constructed of 1-to-1.5-inch ASTM A572 Gr. 50 steel plate.

Another difference between exemplary AVB 10 illustrated in FIGS. 14 and 15 from exemplary AVB 10, illustrated in FIGS. 1 and 2, is with regard to the connection of adjacent beam sections 16 at crash post 22*a*. An exemplary pivotal connection 18 of beam sections 16 to a crash post 22*a* is described with reference in particular to FIGS. 20, 20A, 20B, 21, 21A, 21B, and 22.

Crash posts 22*a* provide beam pivotal connection points on opposite sides of crash post 22*a* (opposite sides of beam web 34). Crash post 22*a* is secured in the ground and oriented such that web 34 extends perpendicular to the longitudinal axis of beam 12 with an attack side flange 36 located on attack side 13 of AVB 10 and asset side flange 38 positioned on asset side 15 of AVB 10. In the illustrated examples, beam connector plate 40 is a steel plate (e.g., 1 to 1.5 inches thick) having pivot pin hole 30 in which a pivot pin 32 (see, e.g., FIG. 17) is disposed to connect beam sections 16 to beam connector plate 40. In the illustrated example, beam connector plate 40 is a unitary (single structure) that extends through a slot 42 in web 34 and is welded to web 34, positioning pivot pin holes 30*a*, 30*b* on opposite sides of web 34, see, e.g., 20A, 20B. Using two or more connector plates will not depart from the scope of this disclosure. In the illustrated examples, pivot pin holes 30 are located closer to attack side flange 36 than to asset side flange 38 and are located longitudinally outside of the ends of crash post flanges 36, 38.

Figure 22:
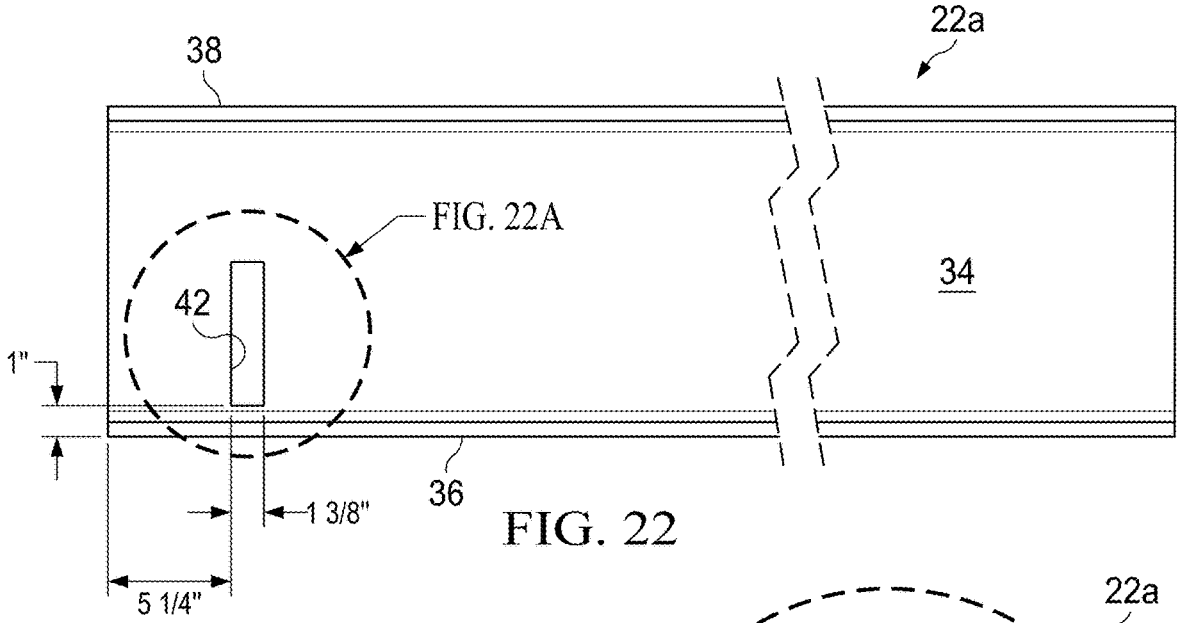
FIG. 22 illustrates an exemplary crash post according to aspects of the disclosure.
Figure 22A:
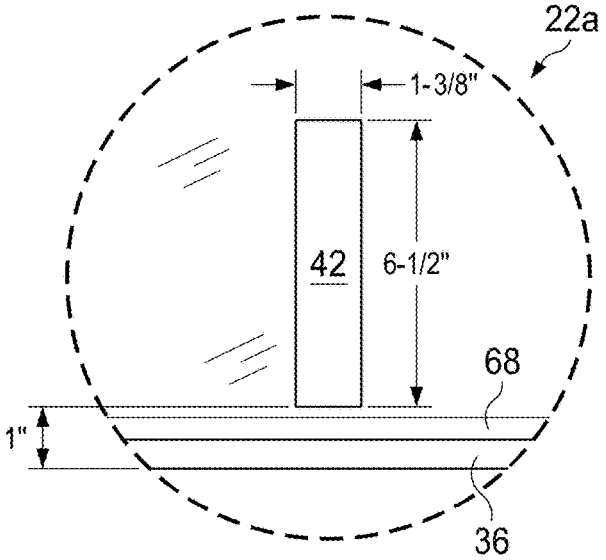
FIG. 22A illustrates an expanded view of a portion of the crash post of FIG. 22.

With reference to FIGS. 22 and 22A, a slot 42 is formed in web 34 of crash post 22*a* extending from proximate to attack side flange 36 and terminating in this example less than the mid-point of web 34. Beam connector plate 40 (FIGS. 21, 21A, 21B), which is a unitary structure in this example, has a longitudinal span 46 that extends a length greater than the length of the crash post flanges 36, 38 and pivot pin holes 30 are spaced apart on along longitudinal span 46. Longitudinal span 46 extends substantially co-axially with the longitudinal axis of AVB 10. In this example, the length of lateral span 48, extending perpendicular to longitudinal span 46, is substantially constant along the length of longitudinal span 46 and the length of lateral span 48 is less than the length of web 34.

Beam connector plate 40 includes an indentation 64 and a tang 66 located on opposite edges of lateral span 48 and proximate to the mid-point along longitudinal span 46. Indentation 64 and tang 66 serve to position beam connector plate 40 relative to web 34 of crash post 22*a*. Indentation 64 is sized to dispose the flange-to-web taper 68 (FIG. 20B, 22A) on attack side flange 36 and tang 66 adds the material and width removed by indentation 64. Once positioned, beam connector plate 40 may be, for example, welded in place.

Figure 23:
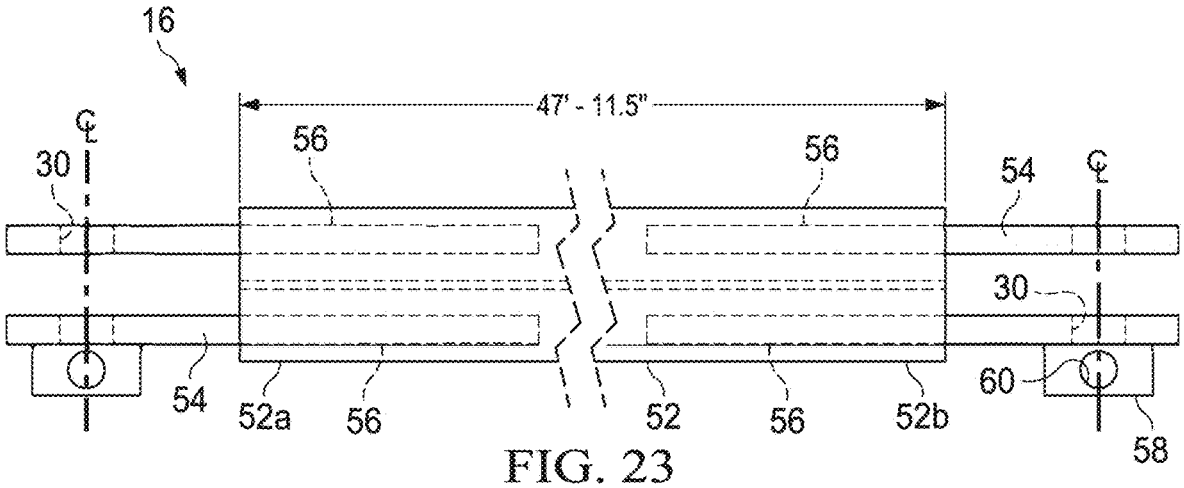
FIG. 23 is a side view of another exemplary beam section according to aspects of the disclosure.
Figure 24:
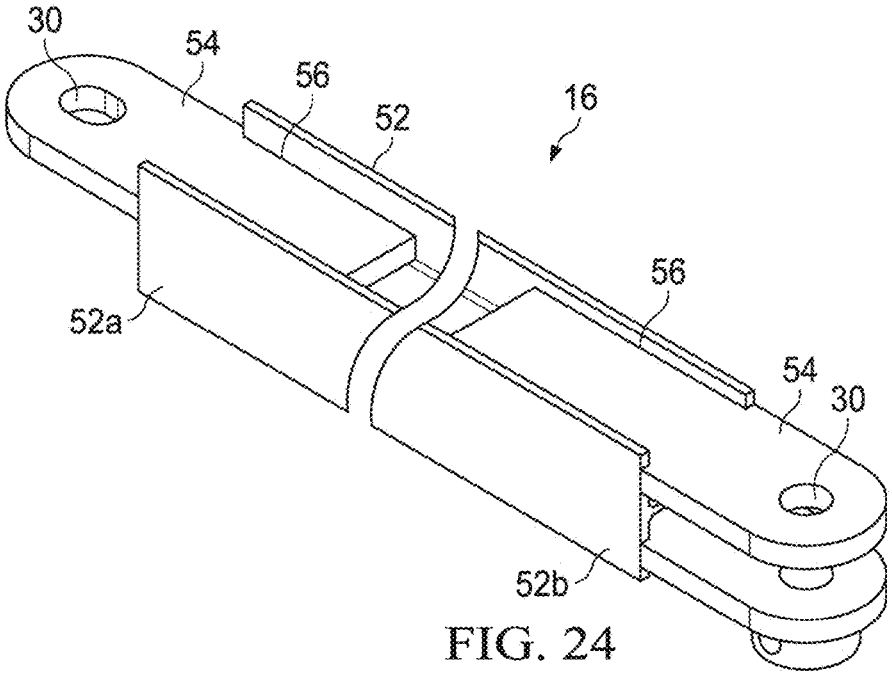
FIG. 24 is a perspective view of another exemplary beam section according to aspects of the disclosure.
Figure 25:
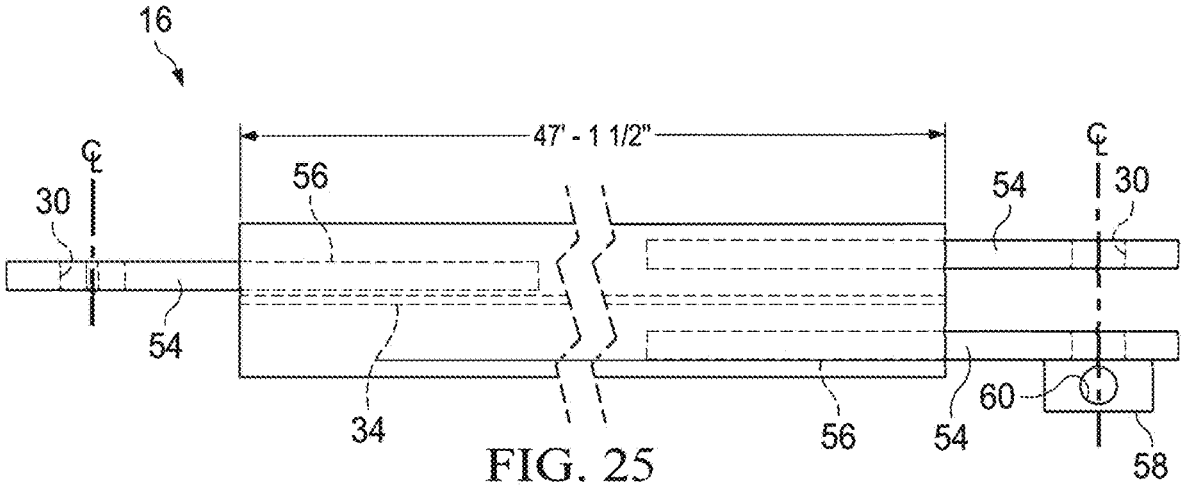
FIG. 25 is a side view of the exemplary beam section of FIG. 24 according to aspects of the disclosure.

FIGS. 23-25 illustrate exemplary beam sections 16. Beam section 16 includes an I-beam 52 having one or more connector plates 54, e.g., warp plates, positioned at opposing ends 52*a*, 52*b*. Each warp plate 54 includes a warp end 56 in direct contact with I-beam 52 and a vertical hole 30 for positioning a pivot pin 32 as shown for example in FIGS. 16, 17, and 19. Beam section 16 illustrated in FIG. 23 includes two vertically separated connector plates 54 at each end 52*a*, 52*b* and may, therefore, be referred to as a female-female beam section. FIGS. 24 and 25 illustrate a female-male beam section 16. In the illustrated exemplary beam sections 16, a metal housing 58 is attached on the bottom end of the lower connector plate 54 below vertical hole 30. Housing 58 may have a lateral opening 60 to align with a cross-hole in the pivot pins to pass a bolt to lock the pivot pin in position. For example, with reference to FIGS. 16, 17, and 19, a pivot pin 32 is disposed in the connector plates to form a pivotal joint 18. A cross-pin 62, such as a carriage bolt, is positioned through lateral opening 60 into pivot pin 32 to lock the pivot pin in place and prevent unauthorized removal.

An exemplary method for creating a vehicle barrier includes installing a longitudinally extending beam positioned vertically above a ground level and separating an asset side from an attack side, the beam comprising beam sections a crash post positioned in a same vertical plane as the beam, wherein adjacent beam sections are pivotally connected to the crash post. The method may also include crash testing the vehicle barrier by ramming a vehicle traveling in a direction from the attack side toward the asset side into the beam.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include such elements or features.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms such as "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction. As used herein, the terms "connect," "connection," "connected," "in connection with," and "connecting" may be used to mean in direct connection with or in connection with via one or more elements. Similarly, the terms "couple," "coupling," and "coupled" may be used to mean directly coupled or coupled via one or more elements.

The term "substantially," "approximately," and "about" is defined as largely but not necessarily wholly what is specified (and includes what is specified; e.g., substantially 90 degrees includes 90 degrees and substantially parallel includes parallel), as understood by a person of ordinary skill in the art. The extent to which the description may vary will depend on how great a change can be instituted and still have a person of ordinary skill in the art recognized the modified feature as still having the required characteristics and capabilities of the unmodified feature. In general, but subject to the preceding, a numerical value herein that is modified by a word of approximation such as "substantially," "approximately," and "about" may vary from the stated value, for example, by 0.1, 0.5, 1, 2, 3, 4, 5, 10, or 15 percent.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure and that they may make various changes, substitutions, and alterations without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A vehicle barrier, comprising:

a beam extending longitudinally between first end post and a second end post, the beam positioned vertically above a ground level and separating an asset side from an attack side;

a first crash post positioned in a same vertical plane as the beam;

a first beam span comprising adjacent beam sections extending from the first end post to the first crash post;

a joint pivotally connecting adjacent beam sections;

a post pivotal connection attaching the first beam span to the first crash post;

a first intermediate post secured to the first beam span between the first end post and the first crash post; and the vehicle barrier configured to achieve an ASTM F2656 designation capable of stopping a 15,000-pound vehicle impacting the beam when traveling in a direction from the attack side toward the asset side within a determined distance.

2. The vehicle barrier of claim 1, wherein the vehicle barrier is configured to achieve an ASTM F2656 M40-P2 designation or greater.

3. The vehicle barrier of claim 1, wherein the first beam span is greater than about 200 feet.

4. The vehicle barrier of claim 3, wherein the vehicle barrier is configured to achieve an ASTM F2656 M40-P2 designation or greater.

5. Has been rewritten as:

The vehicle barrier of claim 1, wherein the post pivotal connection comprises a vertical pin disposed in the first beam span and a post connector plate extending from the first crash post.

6. The vehicle barrier of claim 1, wherein the post pivotal connection comprises:

first plates extending from one of the first beam span or the first crash post;

a connector plate extending from another one of the first beam span or the first crash post and positioned between the first plates; and a pin extending between the connector plate and the first plates.

7. The vehicle barrier of claim 6, wherein the first beam span is greater than about 200 feet.

8. The vehicle barrier of claim 7, wherein the vehicle barrier is configured to achieve an ASTM F2656 M40-P2 designation or greater.

9. The vehicle barrier of claim 1, wherein the joint comprises:

first plates extending from a first one of the adjacent beam sections;

at least one second plate extending from a second one of the adjacent beam sections; and a vertical pin connecting the first plates and the at least one second plate.

10. The vehicle barrier of claim 9, wherein the first beam span is greater than about 200 feet.

11. The vehicle barrier of claim 10, wherein the vehicle barrier is configured to achieve an ASTM F2656 M40-P2 designation or greater.

12. The vehicle barrier of claim 9, wherein the post pivotal connection comprises:

first plates extending from one of the first beam span or the first crash post;

a connector plate extending from another one of the first beam span or the first crash post and positioned between the first plates; and a pin extending between post connector plate and the first plates.

13. The vehicle barrier of claim 12, wherein the first beam span is greater than about 200 feet.

14. The vehicle barrier of claim 13, wherein the vehicle barrier is configured to achieve an ASTM F2656 M40-P2 designation or greater.

15. The vehicle barrier of claim 1, wherein the first intermediate post is located on the asset side and fixedly secured to the first beam span between adjacent joints.

16. A vehicle barrier, comprising:

a beam extending longitudinally between a first end post and a second end post, the beam positioned vertically above a ground level and separating an asset side from an attack side;

a first crash post and a second crash post positioned in a same vertical plane as the beam;

a first beam span comprising adjacent beam sections and extending from the first end post to the first crash post;

a second beam span comprising adjacent beam sections and extending from the first crash post to the second crash post;

joints connecting adjacent beam sections;

post pivotal connections attaching the beam spans to the crash posts; and intermediate posts located on the asset side and secured to the first beam span and the second beam span between adjacent joints.

17. The vehicle barrier of claim 16, wherein the post pivotal connections comprise:

first plates extending from one of the beam span or the crash post;

a connector plate extending from another one of the beam span or the crash post and positioned between the first plates; and a pin extending between the connector plate and the first plates.

18. The vehicle barrier of claim 16, wherein the joints comprise:

first plates extending from a first one of the adjacent beam sections;

at least one second plate extending from a second one of the adjacent beam sections; and a vertical pin connecting the first plates and the at least one second plate.

19. The vehicle barrier of claim 18, wherein the post pivotal connections comprise:

first plates extending from one of the beam span or the crash post;

a connector plate extending from another one of the beam span or the crash post and positioned between the first plates; and a pin extending between the connector plate and the first plates.

20. The vehicle barrier of claim 19, wherein the vehicle barrier is configured to achieve an ASTM F2656 designation capable of stopping a 15,000-pound vehicle impacting the beam when traveling in a direction from the attack side toward the asset side within a determined distance.

* * * * *